US007921760B2

(12) United States Patent
Tankersley

(10) Patent No.: US 7,921,760 B2
(45) Date of Patent: Apr. 12, 2011

(54) COMPACT GAS BLOCK WITH RAIL INTERFACE

(76) Inventor: Jerome Benedict Tankersley, Fredericksburg, VA (US)

( * ) Notice: Subject to any disclaimer, the term of this patent is extended or adjusted under 35 U.S.C. 154(b) by 841 days.

(21) Appl. No.: 11/975,881

(22) Filed: Oct. 22, 2007

(65) Prior Publication Data

US 2010/0282066 A1 Nov. 11, 2010

(51) Int. Cl.
*F41A 5/00* (2006.01)

(52) U.S. Cl. ..... 89/193; 89/191.01

(58) Field of Classification Search ..... 89/191.01, 89/191.02, 192, 193
See application file for complete search history.

(56) References Cited

U.S. PATENT DOCUMENTS 3,330,183 A 7/1967 Loffler
4,798,124 A 1/1989 Hurlemann
5,768,818 A 6/1998 Rustick
5,831,202 A * 11/1998 Rustick ..... 89/193
5,945,626 A 8/1999 Robbins
2006/0283318 A1 12/2006 Beaty

OTHER PUBLICATIONS

Brownells Catalog No. 58, 2005-2006, pp. 21 and 185, pub 2005, Montezuma, Iowa, USA, describing Prior Art rail and low-profile gas blocks.
U.S. Appl. No. 60/734,193, Jerome B. Tankersley.
U.S. Appl. No. 11/593,439, Jerome B. Tankersley.

* cited by examiner

*Primary Examiner* — Michael Carone
*Assistant Examiner* — Daniel J Troy

(57) ABSTRACT

A compact gas block with rail interface has a first longitudinal bore for receiving a firearm barrel, the barrel having a gas port, the gas block having a second longitudinal bore for receiving a gas tube or operating element. The block includes a vertical bore aligned with the barrel gas port and connecting the first and second block bores and permitting passage of cartridge gas from the barrel gas port to the gas tube. The improved gas block includes a military rail, forward of the gas tube, the forward location permitting rail and accessories to lie close to the barrel, enabling handguard installation and removal, improving handling, and reducing firearm bulk.

10 Claims, 3 Drawing Sheets

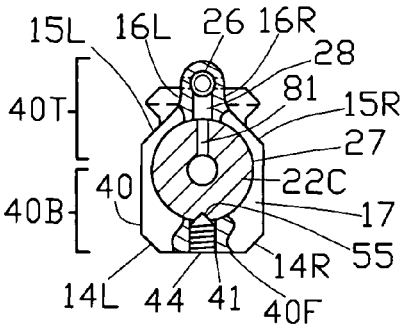
FIG. 5A
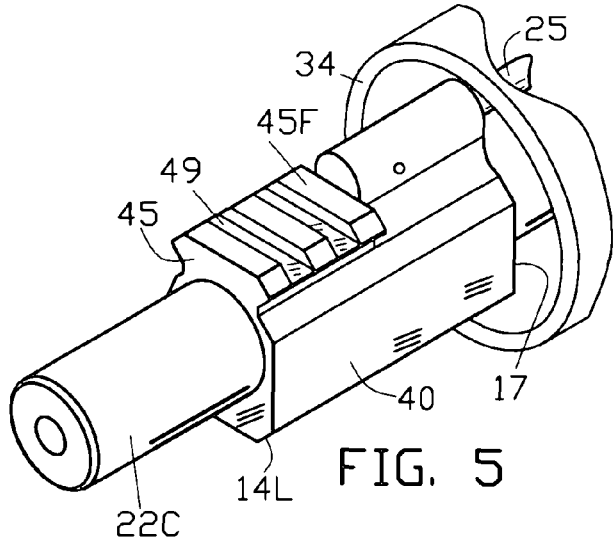
FIG. 5
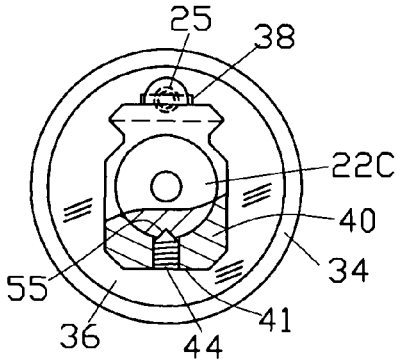
FIG. 5B
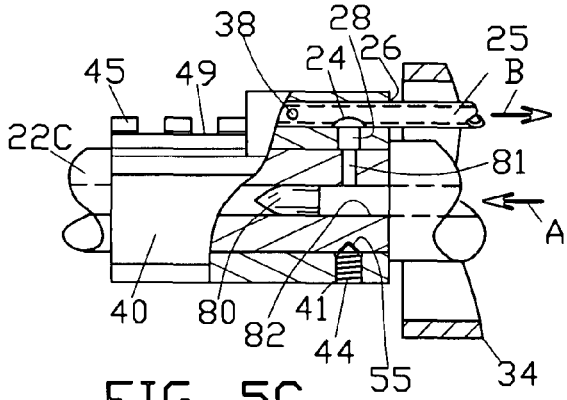
FIG. 5C
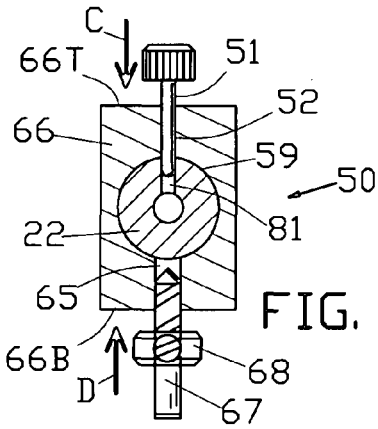
FIG. 6
FIG. 6A
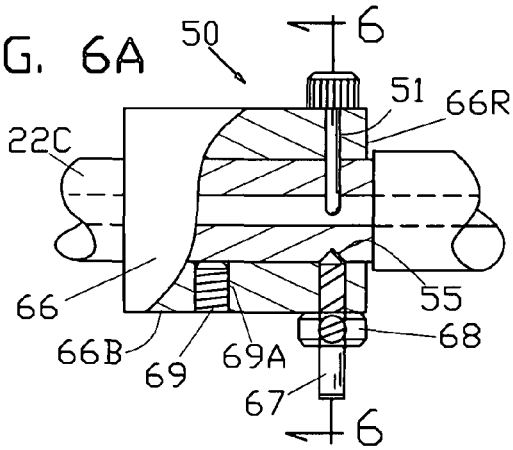

COMPACT GAS BLOCK WITH RAIL INTERFACE

CROSS-REFERENCE TO RELATED APPLICATIONS

None

FEDERALLY SPONSORED RESEARCH

None

SEQUENCE LISTING

None

FIELD OF THE INVENTION

This invention relates to gas blocks for gas operated firearms, and more particularly to gas blocks for M16 style firearms.

BACKGROUND OF THE INVENTION—PRIOR ART

Many gas block configurations have been produced during the continuing development cycle for M16 style firearms. While sharing an internal configuration intended for the primary function of conducting combustion gas from the firearm barrel gas port to a gas tube or operating element, prior art blocks differ externally. Gas block external configuration varies substantially depending on the intended block secondary functions.

Gas blocks in general can be categorized, however, as three basic styles: integral front sight, integral rail, and low profile. Prior art gas blocks are attached to the firearm barrel by various means, including pins, clamping, set screws or a combination of these means. Features of these prior art gas blocks, depicted in FIGS. 1-4, will be discussed in detail presently in order to demonstrate the advantages of the present invention.

Although functional, prior art gas blocks have several important shortcomings:

(a) As a group, after initial factory installation, prior art gas blocks can be characterized as difficult to remove and reinstall while maintaining alignment to the firearm gas port. At initial manufacture, the blocks are generally aligned with the barrel port by means of special fixtures. Consequently, when the gas blocks are removed for any reason, skilled armorers and/or fixtures, or a trial and error method must be used to ensure proper alignment at installation. Robbins, U.S. Pat. No. 5,945,626 includes a key, separate from the securing means, thus requiring two parts to accomplish aligning and securing the gas block, unlike one embodiment of the present invention.

(b) Free-float tubular handguard tubes are becoming the standard for many M16 style firearms. With the exception of some low profile gas blocks (which don't permit mounting a barrel-referenced front sight), prior art gas blocks must be removed from the firearm prior to installation or removal of the handguard. When the prior art gas block includes a rail, the rail as well as the gas block gas port must be re-aligned to the barrel and receiver of the firearm when the gas block is re-installed. This can be a difficult task in the field. Therefore, it is of substantial benefit to the user if the handguard can be removed/re-installed (for cleaning or repair, for example) without the need to remove the gas block.

(c) Prior art integral rail gas blocks are configured to attach ancillary devices substantially outboard of the barrel, the gas block rail being located radially outward of the gas tube, thereby reducing firearm handling qualities and adding to firearm bulk.

It would be highly advantageous, therefore, to remedy these and other deficiencies embodied in the prior art. The advantages of this improved gas block will become apparent after the consideration of the ensuing description and drawings.

SUMMARY

Provided is a compact gas block with rail interface, also referred to herein as an improved gas block. The improved gas block permits cartridge combustion gas to flow from a firearm barrel to a firearm gas tube or operating element, and includes an integral rail located forward of the gas tube, the rail located close to the barrel surface, instead of outboard the gas tube as seen in the prior art. This unique and useful structure of the present invention allows accessory devices to be attached closer to the barrel, improves firearm handling qualities, reduces overall firearm bulk, and enables a firearm handguard to pass over the gas block during maintenance, thus eliminating the need for gas block removal and re-installation.

DRAWINGS—FIGURES

FIG. 5 is a perspective partial view of a rifle with the improved gas block of the present invention attached.

FIG. 5A is a rear end view, with partial sections, of the improved gas block of FIG. 5.

FIG. 5B is a front end view, with partial sections, of the improved gas block of FIG. 5.

FIG. 5C is a side view with partial sections of the improved gas block of FIG. 5B.

FIG. 6 is a cross-sectional view taken generally along section 6-6 of FIG. 6A, of the installation device with alignment pin and drill bit engaging a firearm barrel.

FIG. 6A is a side elevational view, with partial sections, of the installation device of the present invention attached to the firearm barrel.

DRAWINGS—REFERENCE CHARACTERS

Figure 1:
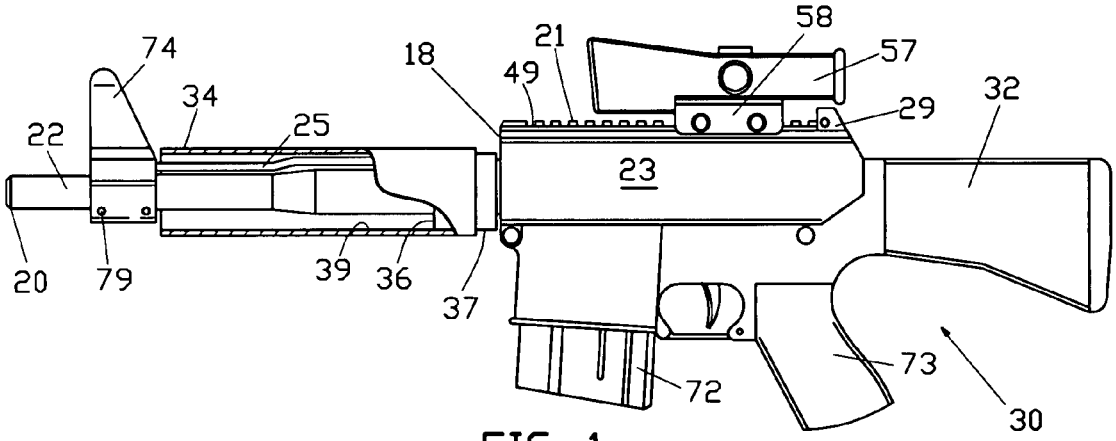
FIG. 1 PRIOR ART
FIG. 1 is a side elevational view of a prior art conventional M16 style firearm with integral front sight gas block, partially sectioned floating handguard, and typical rail mounted accessories installed.

Like parts have like reference characters
14L lower left bevel
14R—lower right bevel
15L—upper left bevel
15R—upper right bevel
16L—left narrow portion
16R—right narrow portion
17—block rear face
18—receiver forward end
19—set screw
20—muzzle
21—receiver top rail
22—barrel
22C—barrel with conical cavity
23—receiver
24—gas inlet
25—conventional gas tube
26—second longitudinal bore
27—first longitudinal bore
28—vertical bore
29—secondary rear sight
30—M16 style firearm
31—prior art low profile gas block
32—stock
33—bayonet lug
34—prior art floating handguard
35—transverse split third embodiment
36—floating handguard barrel nut
37—barrel nut outer surface
38—tube pin short
39—handguard inner surface
40—improved gas block
40T—top portion
40B—bottom portion
40F—bottom face
41—threaded aperture
41H—helicoil insert
42—improved gas block, second embodiment
42F—block bottom face
43—improved gas block, third embodiment
43T—top portion third embodiment
43B—bottom portion third embodiment
43F—bottom face third embodiment
44—cone point set screw
45—top integral rail
45F—top rail face
46—block clamp screw
47—bottom integral rail
48—block longitudinal split portion
49—rail slot
50—installation device
51—alignment pin
52—alignment pin bore
53—open
54—threaded aperture for clamp screw
55—conical cavity
56—prior art integral rail
57—optical gun sight
58—optical gunsight clamp device
59—device first bore
60—removable front sight
61—female dovetail portion
62—military standard 1913 rail portion
63—clamp
64—third embodiment top rail
65—vertical drill bore
66—installation device body
66B—device body bottom face
66R—device body rear face
66T—device body top face
67—drill bit, cone point
68—adjustable drill stop
69—device set screw
69A—device threaded aperture
70—prior art integral rail gas block
71—split portion prior art
72—magazine
73—grip
74—integral front sight block
75—tube pin, long
76—prior art block clamp screw
77—prior art block threaded portion
78—open
79—block securing pin
80—projectile
81—gas port
82—barrel bore
A—direction of gas flow forward
B—direction of gas flow rearward
C—direction of alignment pin insertion
D—direction of drill bit insertion

DETAILED DESCRIPTION OF THE INVENTION

For the purposes of this application, the term "M16 style" firearm refers to gas operated rifles and carbines with common design features and various designations including M16A2, AR15, M4 and AR10. However it is to be understood that other firearms could benefit from this invention.

Referring now to the drawing figures where like reference characters indicate like parts throughout the various figures, FIG. 1 through FIG. 4 depict prior art examples which are important to demonstrating the advantages of the present improved gas block.

Speaking generally, all gas blocks presented in this application, both prior art examples and the improved gas block of the invention, have the same primary function of receiving cartridge combustion gases from the firearm barrel and permitting the gases to flow to a firearm gas tube or operating element. Thus, the prior art discussion below will not describe the block internal configurations, well known in the prior art.

FIG. 1 shows a side elevational view of a prior art M16 style firearm generally designated 30. A barrel 22 having a forward end or muzzle 20 is joined to a conventional upper receiver 23. A conventional floating handguard barrel nut 36 secures barrel 22 to receiver 23. The longitudinal axis of barrel 22 is considered to lie in a horizontal plane, for the purposes of this application.

Nut 36 includes an outer surface 37. A typical prior art floating handguard 34, has an inner diameter 39. Inner diameter 39 engages nut outer surface 37. Prior art nut and handguard engaging surfaces are generally either smooth or threaded, and handguards may be removably secured to nuts with means such as set screws or lock rings. Floating handguard 34 is attached to firearm 30 at one end only. Handguards of this type have generally proven to positively influence firearm accuracy, and when fitted with military standard rails may receive a variety of accessories.

Continuing with FIG. 1, an integral front sight gas block 74 is attached to barrel 22 with means such as a pin 79. FIG. 1 shows front sight gas block 74 having a configuration substantially larger than handguard inner diameter 39, and consequently gas block 74 must be removed prior to removing handguard 34 for maintenance, thereby adding difficulty to that process.

A gas tube 25 connects gas block 74 to receiver 23. Gas block 74 serves to direct gas from barrel 22 into gas tube 25.

Still referring to FIG. 1, receiver 23 includes a forward end 18, a top rail portion 21 configured with a military standard rail having a dovetail cross section and further including a plurality of transverse slots 49. This rail configuration is also known as a MIL-STD-1913 rail.

Mounted to rail 21 are conventional rail mounted accessory devices including a secondary or back up rear sight 29, and an optical gunsight 57, sight 57 including a rail clamp device 58 for attaching sight 57 to rail 21. With the increasing use of optical gunsights, there can be difficulties with front sight block 74 obscuring line of sight of gunsight 57, and blocking handguard 34 removal. Firearm 30 further includes a stock 32, stock 32 defining firearm 30 rear portion, a grip 73, and a magazine 72.

Figure 2:
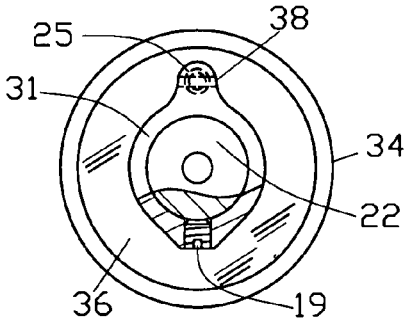
FIG. 2 PRIOR ART
FIG. 2 is a front end view, with partial sections, of a prior art low profile gas block mounted to a barrel, with partial handguard, shown in enlarged scale compared to FIG. 1.

Referring now to FIG. 2, presented is an enlarged scale, front view with partial sections of a prior art low profile gas block 31 mounted to rifle barrel 22 and surrounded by handguard 34 which is attached to barrel nut 36. A pin 38 secures tube 25. A plurality of standard set screws 19, the screws 19 generally with a concave or cup point, secure low profile gas block 31 to barrel 22.

Figure 2A:
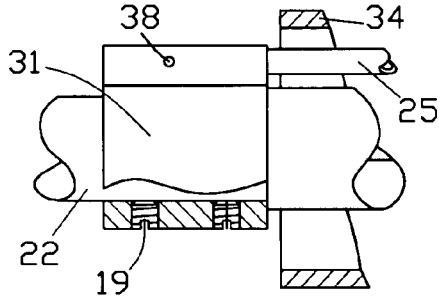
FIG. 2A PRIOR ART
FIG. 2A is a side elevational view, with partial sections, of the prior art low profile gas block of FIG. 2, shown in enlarged scale compared to FIG. 1.

Referring now to FIG. 2A, presented is an enlarged scale, side view with partial sections of a prior art low profile gas block 31 mounted to a portion of rifle barrel 22, the barrel surrounded by a portion of handguard 34. Tube 25 is shown retained with pin 38. Block 31 is shown retained with plurality of screws 19.

Low profile gas blocks 31 were developed to overcome the problems described immediately above regarding integral front sight blocks 74. However, prior art low profile blocks 31, to the applicant's knowledge, do not incorporate the advantages of the present invention, such as including the means to rail mount a removable front sight.

Figure 3:
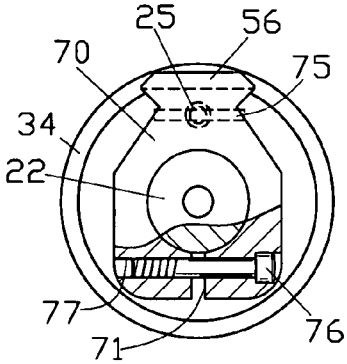
FIG. 3 PRIOR ART
FIG. 3 is front end view, with partial sections, of a prior art integral rail gas block mounted to a barrel, with partial handguard, shown in enlarged scale compared to FIG. 1.

Referring now to FIG. 3, presented is an enlarged scale front view with partial sections of a prior art integral rail gas block 70 mounted to rifle barrel 22 and surrounded by handguard 34. A pin 75 secures gas tube 25.

Rail block 70 includes a centrally located split 71, a threaded portion 77 and a plurality of clamp screws 76. Screws 76, engaging portion 77, when tightened, clamp block 70 to barrel 22.

A standard military rail 56 is formed into the top portion of block 70. Rail 56, mounted above gas tube 25 presents the difficulty of blocking removal of typical floating handguard 34, and rail 56 mounts accessory devices substantially outboard of barrel 22, adding bulk to the firearm.

Figure 3A:
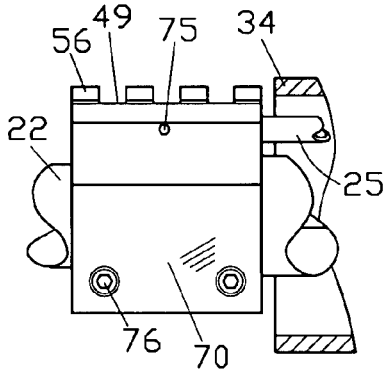
FIG. 3A PRIOR ART
FIG. 3A is a side elevational view of the integral rail gas block of FIG. 3, shown in enlarged scale compared to FIG. 1.

Referring now to FIG. 3A, presented is an enlarged scale, side view with partial sections of prior art integral rail gas block 70 mounted to a portion of rifle barrel 22, the barrel surrounded by a portion of handguard 34. Tube 25 is shown retained with pin 75. Block 70 is shown retained with clamp screws 76.

Figure 4:
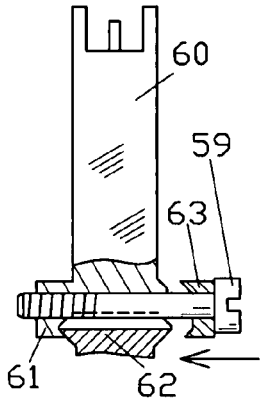
FIG. 4 PRIOR ART
FIG. 4 is a front view, with partial sections, of a typical prior art removable front sight disposed on a segment of a military rail, enlarged scale compared to FIG. 1.

Referring now to FIG. 4, presented is an enlarged scale, front view with partial sections of a prior art removable front sight 60. A military rail portion 62 is shown receiving front sight 60. A female dovetail portion 61 of sight 60 receives rail 62. A clamp 63 and a clamp screw 59 are positioned to engage rail 62 when screw 59 threadably engages sight dovetail portion 61 and is tightened. Clamp 63 and screw 59 move in the direction of the arrow, toward rail 62.

Removable sights 60 are typically used in combination with typical rail block 70 to avoid blocking line of sight for an optical sight such as gunsight 57 of FIG. 1.

Moving forward now, away from prior art, the present invention is best described if FIGS. 5-5C are considered together. FIG. 5 is a front perspective view of an improved gas block 40, block 40 attached to a portion of an M16 style firearm similar to firearm 30 of FIG. 1, the firearm shown in an enlarged scale compared to FIG. 1.

FIG. 5 depicts the improved gas block 40, a barrel 22C, and prior art gas tube 25. Barrel 22C and tube 25 are shown partially surrounded by typical floating handguard 34. Block 40 includes a rear face 17 and a top rail 45. Rail 45 includes a plurality of rail slots 49 and an outward face 45F. FIG. 5 depicts rail 45 disposed forward of gas tube 25, the forward location allowing rail 45 to lie close to barrel 22C, unlike prior art rail block 70 shown previously in FIGS. 3-3A.

FIG. 5A is a rear end view with partial sections of the improved gas block of FIG. 5 showing the rear face 17, a block top portion 40T, a bottom portion 40B, a bottom face 40F, a longitudinal first bore 27, a longitudinal second bore 26, and a vertical bore 28.

Considering rear face 17, shown are upper left and right narrow portions 16L and 16R, upper left and right bevels 15L and 15R, lower left and right bevels 14L and 14R.

Narrow portions 16L, 16R and bevels 15L, 15R, 14L, 14R, extend forward on the block each a predetermined distance. FIG. 5A shows that barrel 22C includes a gas port 81 aligned with vertical bore 28.

Referring now to FIG. 5B, presented is a front view with partial sections of gas block 40 of FIG. 5, showing barrel 22C, typical handguard 34 attached to prior art barrel nut 36, cone point set screw 44, threaded aperture 41, barrel conical cavity 55, and gas tube 25 secured by a pin 38. FIG. 5B demonstrates that the unique location of top rail 45 forward of the gas tube 25 and close to barrel 22C, permits typical handguard 34 to pass over improved block 40 unlike prior art rail gas blocks as illustrated in FIGS. 3-3A.

Referring now to FIG. 5C, presented is a side view with partial sections of the improved gas block of FIG. 1, shown are barrel 22C, second bore 26 receiving gas tube 25, barrel 22C surrounded by a portion of handguard 34, and tube 25 retained with pin 38. Tube 25 is shown having a gas inlet 24. Barrel 22C is shown having a barrel bore 82 and a projectile 80.

Improved gas block 40 is shown secured and aligned to barrel gas port 81 by means of cone point screw 44 mating with barrel conical cavity 55. With screw 44 tightened, cone point screw 44, barrel conical cavity 55 barrel gas port 81, vertical bore 28, and gas tube gas inlet 24 are all aligned in this preferred embodiment. Screw 44 and cavity 55 could be offset longitudinally from gas port 81 but axial alignment is presently preferred.

FIG. 5C also shows a projectile 80 moving forward through barrel 22C. A barrel bore 82 guides projectile 80, which is propelled by cartridge combustion gas, not shown, moving forward in arrow direction A behind projectile 80. The pressurized gas travels through gas port 81, through block vertical bore 28, into tube gas inlet 24 and rearward through tube 25 in direction of arrow B. Barrel 22C differs from a conventional barrel 22 in that barrel 22C includes a conventional gas port 81, but also a conical cavity 55 disposed on the barrel surface opposite gas port 81.

Cavity 55 may be offset longitudinally from gas port 81, but alignment with gas port 81 is the present preferred disposition of cavity 55. Conical cavity 55 is required for embodiments of the present invention 40 in which conical point screw 44 is provided to secure and align block 40 to barrel 22C as shown in FIG. 5B.

Referring now to FIGS. 6 and 6A, FIG. 6 is a cross-sectional view taken generally along section 6-6 of FIG. 6A, of an installation device of the present invention, generally designated 50. FIG. 6 shows a device body 66, a conventional firearm barrel 22, an alignment pin 51, a drill bit with cone point 67, a vertical drill bore 65, a drill stop 68, and conventional firearm barrel 22, barrel 22 including gas port 81.

Installation device 50 prepares conventional firearm barrel 22 to cooperate with the improved gas block 40 of the present invention. Shown in FIGS. 6-6A, the device 50 is intended to form conical cavity 55, in barrel 22, cavity 55 disposed on barrel 22 diametrically opposite the barrel gas port 81. After cavity 55 is formed on conventional barrel 22, the barrel is designated 22C.

Body 66 being generally a one-piece elongated rectangular metal block, the long axis of device body 66 generally horizontal during use, block 66 including a rear face 66R, a top face 66T and a bottom face 66B, rear face 66R defined as having a first longitudinal bore 59, the first bore adapted to receive the firearm barrel 22.

The first bore 59 extending through the length of block 66, the block top face 66T including alignment pin vertical bore 52, pin vertical bore 52 extending from the block top face 66T into the first longitudinal bore 59, the axis of pin vertical bore 52 intersecting with the axis of first bore 59.

Pin vertical bore 52 is adapted to slideably receive the alignment pin 51, the alignment pin adapted to slideably engage the barrel gas port 81 for the purpose of aligning barrel 22 with the installation device 50.

FIG. 6A is a side elevational view, with partial sections, of installation device 50 attached to firearm barrel 22C, showing the barrel after cavity 55 has been formed by drill bit 67. Barrel 22C is the designation given to generally identical barrel 22 after cavity 55 has been formed in barrel 22. The bottom face 66B includes device threaded aperture 69A, the threaded aperture 69A extending into the longitudinal first bore, the axis of aperture 69A intersecting the axis of first bore 59.

Means such as set screw 69 threadably engages aperture 69A and is tightened against barrel 22C for the purpose of clamping barrel 22C to the installation device 50.

Bottom face 66B further includes drill bore 65, bore 65 adapted to guide standard cone point drill bit 67, the drill cone angle being generally identical with the cone angle of the cone point set screw 44 of the present invention, shown in FIG. 5A, drill bit 67 further defined as being fitted with beforementioned conventional adjustable drill stop 68 for the purpose of controlling depth of the firearm barrel conical cavity 55.

Continuing to refer to FIGS. 6-6A, when drill bit 67 is powered by a conventional drilling machine, not shown, and advanced to a predetermined depth, a conical cavity 55 is formed in the barrel 22C surface, diametrically opposite the barrel gas port 81, permitting the cone point set screw 44 of the improved gas block 40, when engaging the barrel conical cavity 55, and tightened, to both align the gas block 40 to the barrel gas port 81, longitudinally and rotationally, and at the same time securely clamp the improved gas block 40 to barrel 22C.

If desired, additional drill guide bores 65, not shown may be positioned at predetermined longitudinal locations on device bottom face 66B in order to form additional barrel conical cavities 55 to mate with additional cone point screws 44.

Figure 7:
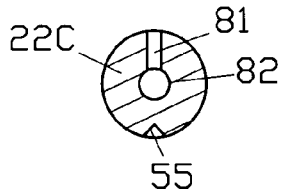
FIG. 7 is a cross-sectional view of the firearm barrel after cavity formation by the installation device, taken generally at section line 6-6.

Referring now to FIG. 7, shown is a cross-sectional view of firearm barrel 22C, after modification by the installation device 50, taken generally at section 6-6, and showing barrel 22C, barrel bore 82, gas port 81 and conical cavity 55, cavity 55 disposed diametrically across from gas port 81.

Figure 8:
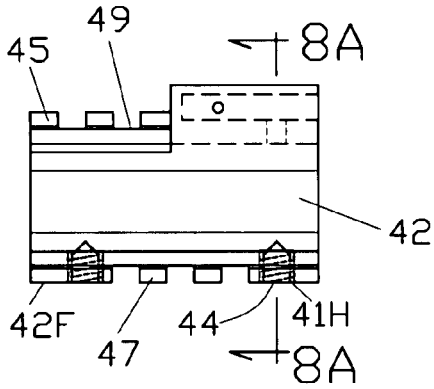
FIG. 8 is a side elevational view of a second embodiment of the improved gas block including a second rail.

FIG. 8 shows a side elevational view of a second embodiment 42 of the present invention including a second or bottom rail 47, a bottom face 42F, a pair of threaded helicoil inserts 41H, each receiving a cone point set screw 44. Rail 47 is disposed generally opposite top rail 45. Cone point set screws 44 engaging inserts 41H are disposed perpindicular to block bottom face 42F.

Figure 8A:
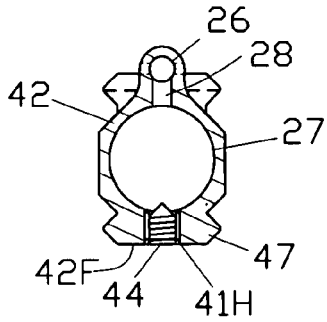
FIG. 8A is a cross-sectional view taken at section line 8A-8A of the second embodiment shown in FIG. 8.

Now referring to FIG. 8A, shown is a cross-sectional view taken at section 8A-8A of the second embodiment 42 shown in FIG. 8. Shown are gas tube or second bore 26, first bore 27, vertical bore 28 and bottom rail 47 formed into block 42.

Figure 9:
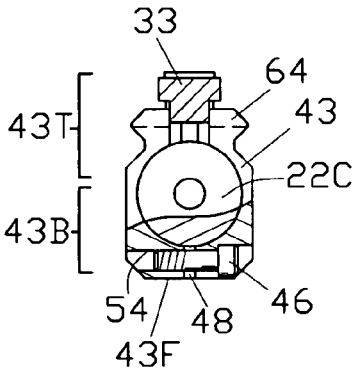
FIG. 9 is a front end view with partial sections, of a third embodiment of the improved gas block, including a bayonet lug generally along section line 9-9.
Figure 9A:
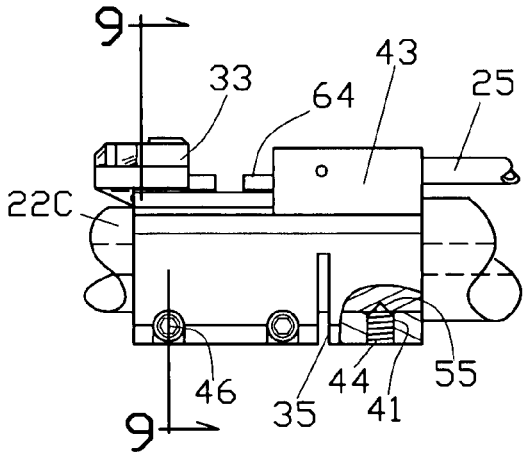
FIG. 9A is a side elevational view of the third embodiment of the improved gas block, with a partial section.

FIGS. 9-9A showing a third embodiment of the present invention, should be considered together. FIG. 9 is a front end section view with partial sections, of a third embodiment of the present invention, generally taken along section line 9-9.

Shown is a third embodiment gas block 43 attached to barrel 22C, a block top portion 43T, and a bottom portion 43B with a bottom outward face 43F, a top rail 64, a bayonet lug 33, a longitudinal slot 48, and a clamp screw 46, one of a plurality. A block threaded aperture 54, one of a plurality, receives clamp screw 46.

FIG. 9A is a side elevational view of the block of FIG. 9, with partial sections. Shown are gas block 43, attached to barrel 22C, top rail 64, bayonet lug 33, tube 25, a transverse slot 35, plurality of screws 46, and cone point screw 44 engaging threaded aperture 41, and mating with barrel conical cavity 55.

Referring to FIGS. 9-9A together, bayonet lug 33 is disposed on block top portion 43T, forward of top rail 64. Lug 33 is adapted for attaching a standard bayonet or other device with a compatible mounting means, not shown.

Improved block 43 is similar to block embodiment 40 in that it includes similar top rail 64 and cone point set 44 engaging threaded aperture 41. Block 43 differs from embodiment block 40 by including lug 33 and also including the plurality of clamp screws 46, the clamp screws 46 disposed at transverse threaded apertures 54 in the block bottom portion 43B, forward of set screw 44.

The block lower portion 43B includes transverse slot 35 through the block, the slot 35 is disposed forward of set screw 44 for separating the clamp screw clamping action from the set screw clamping action, the transverse slot 35 height dimension lying in a vertical plane. Block lower portion longitudinal slot 48 is centrally located, and slot 48 intersects with the block transverse slot 35 and extends forward through the block, the slot 48 breaking into the block first longitudinal bore 27 and through the block bottom outward face 43F, the slot permitting transverse clamping of the block 43 to the barrel 22C, enabling the improved gas block 43 to be supplementally secured to barrel 22C.

CONCLUSIONS, RAMIFICATIONS, AND SCOPE

Accordingly, the reader will see that, according to the invention, provided is a compact gas block with rail interface that overcomes several disadvantages of the prior art, the unique structure adding to the utility of the firearm, particularly with regard to accessories interface, handling, and maintenance. While the above description contains many specific details, these should not be considered as limitations, but rather as examples of presently preferred embodiments.

Accordingly, the scope of the invention should be limited not by the embodiments, but by the appended claims and their legal equivalents.

I claim:

1. An improved gas block for use on a firearm, the firearm having a barrel, a receiver with a forward end, and a gas tube with a gas inlet, the barrel and gas tube joined to the receiver forward end, the improved gas block comprising:

a gas block being a single unitary part, generally rectangular in cross-section, the gas block having a bottom portion with a bottom face, a rear face, and a top portion, the bottom portion adapted with means to secure the improved gas block to the barrel, rotationally and longitudinally, the rear face defined as having a first longitudinal bore, the bore extending forward through the block length, the first bore adapted to receive the firearm barrel, the rear face further defined as having a second longitudinal bore, the second bore offset and disposed above the first bore and extending forward a predetermined distance, the second longitudinal bore adapted to receive the firearm gas tube, the block further including a vertical bore for connecting the first bore with the second longitudinal bore, the vertical bore further defined as aligned with both the barrel gas port and the tube gas inlet, permitting gases to pass from the barrel gas port, through the vertical bore, into the tube inlet, and rearward to the firearm receiver, the beforementioned block top portion defined as including the second bore, and further including a top portion located forward of the second bore and located lower than the top most portion of the second bore, the forward location permitting the rail to be located close to the barrel surface, the top rail extending from adjacent the gas tube and second bore, forward a predetermined distance, the rail running longitudinally and formed into a standard military dovetail cross-section shape including a pattern of transverse slots, for securing standard devices; whereby:

accessories can be mounted closer to the barrel, improving firearm handling;

a firearm handguard, including its complement of accessories, can be removed quickly, passing over the improved gas block, without the need to remove the gas block from the barrel.

2. The improved gas block of claim 1 in which the means for securing the block to the firearm barrel comprises a threaded aperture in the block bottom face the aperture adapted to receive a set screw, the screw disposed to apply pressure to the barrel.

3. The improved gas block of claim 2 in which the rear face is further defined as being narrowed on either side of the second bore, the narrowed portion extending forward a predetermined distance; and the rear face further defined as having upper left and right bevels and lower left and right bevels, the bevels extending forward a predetermined distance through the block.

4. The improved gas block of claim 2 in which the means for securing the block to the firearm barrel comprises a helicoil insert in the block bottom face, the insert adapted to receive a set screw , the screw disposed to apply pressure to the barrel;

whereby said improved gas block is secured to said barrel.

5. The improved gas block of claim 2 in which the set screw received by the threaded aperture in the bottom face is a conical point set screw, and the firearm barrel further includes a conical cavity, the barrel conical cavity configured to mate with said conical point set screw at a predeterMined barrel location; whereby:

the conical point set screw when tightened into said conical cavity, forces alignment of said gas block to a predetermined barrel location, both longitudinally and rotationally, while at the same time applying clamping pressure between the barrel and gas block; and, the improved gas block can be readily and accurately aligned and secured to the barrel using simple tools, without fixtures, both at initial manufacture and in subsequent maintenance procedures.

6. The improved gas block of claim 1 in which the means for securing the block to the firearm barrel comprises a plurality of threaded apertures in the bottom face, the apertures each adapted to receive a set screw, the set screws disposed to apply pressure to the barrel; whereby: said improved gas block is secured to said barrel.

7. The improved gas block of claim 1 in which the means for securing the block to the firearm barrel comprises one or more transverse threaded apertures in the block bottom portion, each aperture for receiving a headed screw, the block bottom portion including a longitudinal slot, the slot generally bisecting a predetermined length of the bottom face, the slot allowing flexure of the block bottom portion when a headed screw is tightened; whereby: said block is clamped securely to said barrel.

8. The improved gas block of claim 1 in which the means for securing the block to the firearm barrel comprises one or more transverse holes in the block bottom portion in cooperation with one or more similar, aligned, holes in said firearm barrel, each aligned block and barrel hole for receiving a press-fit pin; whereby: when a press-fit pin is pressed into one or more said aligned holes, said block is secured to said barrel.

9. The improved gas block of claim 1 in which the gas block lower portion is formed into a second military standard rail, generally opposite the top rail, the second rail running a predetermined longitudinal distance along said gas block bottom portion;

whereby: additional accessories may be mounted to the block bottom rail.

10. The improved gas block of claim 1 further including a bayonet lug, the lug disposed on the top portion of the block, the lug positioned forward of said top rail, said lug embodied as a small outward projection, said bayonet lug configured to mate with the receptacle of a bayonet or other compatible device; whereby: said improved gas block has additional interface capability.

* * * * *